United States Patent [19]

Rise

[11] Patent Number: 4,566,616

[45] Date of Patent: Jan. 28, 1986

[54] CONTAINERS AND HOLDERS FOR USE IN SECURING SUCH CONTAINERS TO BELTS

[76] Inventor: Leif Rise, 7748 Westlawn Ave., Los Angeles, Calif. 90045

[21] Appl. No.: 618,062

[22] Filed: Jun. 7, 1984

[51] Int. Cl.[4] ..... A45F 5/00

[52] U.S. Cl. ..... 224/253; 224/220; 224/226

[58] Field of Search ..... 224/253, 252, 251, 249, 224/247, 271, 269, 196, 255, 240, 101, 220, 904, 226

[56] References Cited

U.S. PATENT DOCUMENTS

| | | | |
|---|---|---|---|
| 1,328,988 | 1/1920 | Eckert et al. . | |
| 1,619,782 | 3/1927 | Archila . | |
| 1,989,527 | 1/1935 | Powers . | |
| 2,560,376 | 7/1951 | Waterman . | |
| 3,401,529 | 9/1968 | Fifield | 224/247 X |
| 3,616,571 | 11/1971 | Adickes | 224/255 X |
| 3,777,953 | 12/1973 | Lewis . | |
| 3,890,733 | 6/1975 | Kubik | 224/253 X |
| 4,049,165 | 9/1977 | Goldhaft | 224/255 X |
| 4,194,655 | 3/1980 | Tillotson . | |
| 4,200,249 | 4/1980 | Synstelien et al. | 224/255 X |
| 4,442,962 | 4/1984 | Musgrave | 224/255 |

*Primary Examiner*—Stephen Marcus
*Assistant Examiner*—Robert Petrik
*Attorney, Agent, or Firm*—Edward D. O'Brian; K. H. Boswell

[57] ABSTRACT

A container can be detachably secured to a holder carried by a belt through the use of coacting structures on the container and the holder which serve to prevent movement of the container away from the holder until an appropriate portion of the holder is manipulated so as to release the container. This combination of a holder and container can be effectively utilized to hold valuables during athletic pursuits or other underwater activities.

5 Claims, 12 Drawing Figures

FIG. 1.
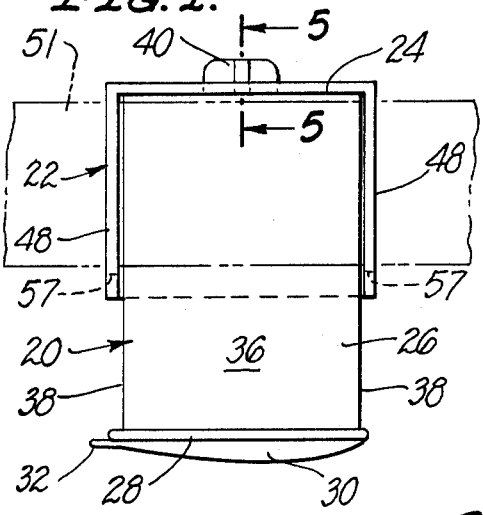
FIG. 2.
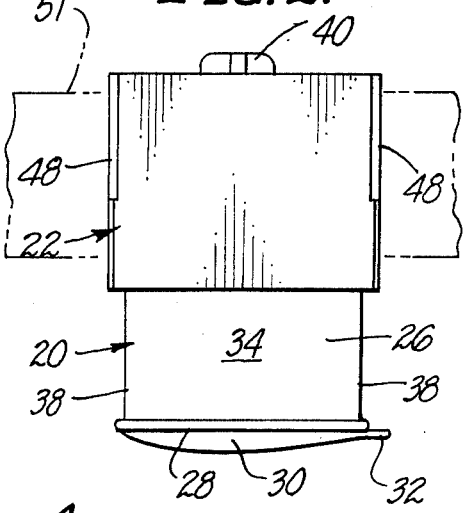
FIG. 3.
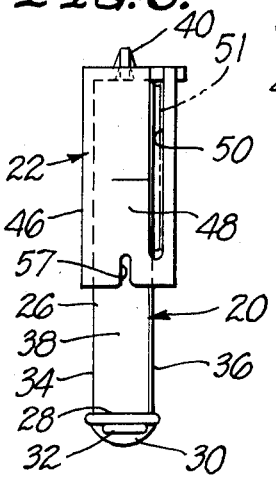
FIG. 4.
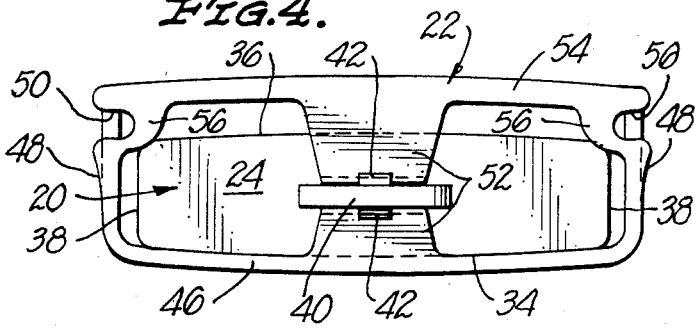
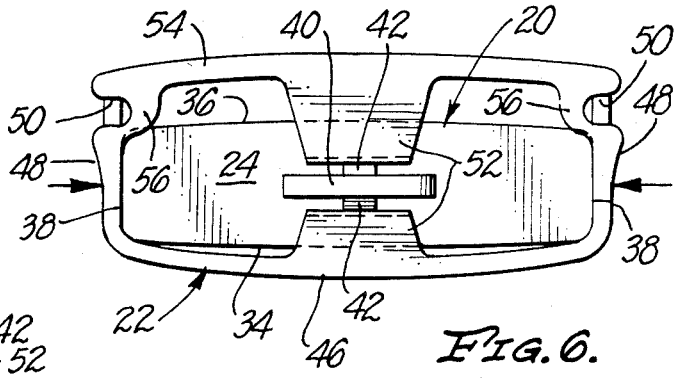
FIG. 6.
FIG. 5.
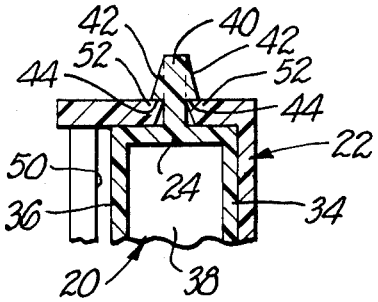

CONTAINERS AND HOLDERS FOR USE IN SECURING SUCH CONTAINERS TO BELTS

BACKGROUND OF THE INVENTION

The invention set forth in this specification pertains to new and improved containers, to new and improved holders for use in securing such containers to belts and to the combination of such containers and holders. More specifically it pertains to the combination of a container and a holder which is primarily intended to be utilized in various athletic activities such as underwater activities for the purpose of maintaining items such as paper money, a drivers license, credit cards and the like on the body of a person engaged in such activities.

It is believed that the reasons for and need for the present invention will be reasonably apparent from the latter sentence. One of the problems often encountered by individuals engaging in various athletic activities, especially activities such as scuba diving, snorkeling or just plain swimming concerns the safety of valuable items. In the past it has been conventional for individuals indulging in such activities to store such valuables along with their clothing in appropriate lockers or to entrust such valuables to various others for safe keeping.

Both of these types of approaches to the problem of dealing with valuables have their limitations and disadvantages. The usual lockers used in so-called locker rooms as are employed by persons who are changing into the appropriate garb for athletic activity are notoriously susceptible to robbery. Frequently this is the result of the quality of the construction used in the lockers and/or the quality of the locks used with them. On many occasions it is impossible to locate a trust-worthy individual who will watch a person's valuables as a person is engaged in athletic activities. The various "valuable" storage systems which are occasionally utilized in connection with locker rooms are often susceptible to thievery.

As a result of these factors it is considered that there is a need for a new method of safeguarding various valuables of a person engaging in various athletic activities, especially underwater activities. More specifically, it is believed that there is a need for a way for persons engaged in an athletic or similar activities to carry their most important valuables with them so that they can avoid worrying about these valuables as they are engaged in these athletic activities.

BRIEF SUMMARY OF THE INVENTION

The invention is intended to fulfill these broad needs. The invention is also intended to provide new and improved containers and holders which are adapted to be utilized for the purpose of storing valuable articles and which are quite desirable: in that they may be easily and conveniently manufactured at a nominal cost; in that such holders may be easily installed on a belt; in that valuables may be easily located within the containers; in that the containers may be easily attached to and removed from these holders as desired during the use of a container-holder combination as indicated, and in that both the container and the holder are capable of being utilized over a comparatively long period without significant chance of either or the contents of the container becoming damaged as a result of such use. A container-holder combination in accordance with this invention is considered to be especially desirable in connection with protecting valuables during underwater activities.

In accordance with this invention these and other objectives are achieved by providing in the combination of a container and a holder which is used to secure the container to a belt so that the container can be easily attached to or detached from the belt through the use of the holder the improvement which comprises: said container having ends and a body portion extending between and separating said ends, said holder being shaped so as to include an open end, a generally closed end and a body portion extending between said ends and shaped so as to fit around at least a portion of said body portion of said container, coacting means for removably securing one of said ends of said container to said closed end of said holder one of said coacting means being located on said one of said ends of said container and the other of said coacting means being located on said closed end of said holder, said coacting means on said holder capable of being manually engaged and manipulated so as to no longer coact with said coacting means on said container so as to release said container from said holder, said coacting means on said holder being capable of being actuated so as to coact with said coacting means on said container so as to secure said container to said holder upon the insertion of said one of said ends of said container and at least the adjacent body portion of said container through said open end of said holder to a position in which said one of said ends of said container and said closed end of said holder are adjacent to one another, said holder also including belt engagement means for use in securing said holder to a belt.

BRIEF DESCRIPTION OF THE DRAWINGS

FIG. 1 is a rear elevational view of a presently preferred container and a presently preferred holder of the invention in use in combination with one another;

FIG. 2 is a front elevational view of the same combination;

FIG. 3 is a side elevational view of this same combination;

FIG. 4 is a top end view of the same combination at an enlarged scale;

FIG. 5 is a partial cross sectional view taken on line 5—5 of FIG. 1;

FIG. 6 is a view corresponding to FIG. 4 showing the configuration of a portion of the holder as the container is in the process of being removed;

Figure 7:
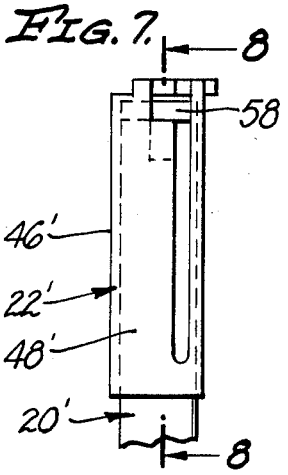
FIG. 7 is a side elevational view corresponding to FIG. 3 of a modified container and holder in accordance with this invention used in combination with one another.

The drawings are primarily intended to be used for explanatory purposes in explaining the nature of various structures as are illustrated. These have all been constructed in accordance with the concepts or principles of the invention. These concepts or principles of the invention are set forth in and defined in the appended claims. It is believed that anyone skilled in the design and construction of various items of underwater, scuba and related equipment and in the design and construction of hiking and running equipment will have little difficulty in providing a variety of somewhat differently appearing and somewhat differently constructed items utilizing the concepts of this invention on the basis of the disclosure in this specification through the use or exercise of routine engineering skill. For this reason the invention is not to be considered as being limited to the precise structures illustrated.

DETAILED DESCRIPTION

In FIGS. 1 to 6 of the drawings there is shown a container 20 which is used in combination with a holder 22. This container 20 is of a generally flat, rectilinear configuration and includes a closed end 24 separated by a body portion 26 from a normally opened end 28. This end 28 is shown as being closed by a conventional lid or closure 30. This closure 30 preferably fits relative to the open end 28 in a known or conventional manner so as to form a fluid tight seal. If desired a small lip 32 may be located on the closure 30 for the purposes of facilitating being manipulated.

The body portion 26 includes a front 34 and a back 36. These are nearly parallel and are connected by sides 38. The closed end 24 in the embodiment of the invention shown carries a small ratchet member 40. This ratchet member 40 may be referred to as a single coacting means because of its functions as hereinafter described. It extends from the closed end 24 and includes sloping surfaces 42 leading to shoulders 44 which are located generally parallel to the closed end 24 and are spaced from it.

The holder 22 includes a front wall 46 which is shaped so as to extend generally along the front 34 of the container 20 and so as to extend shortly beyond the sides 38 of this container 20 as shown in FIG. 4. This wall 46 is integrally formed with side walls 48 which normally extend substantially parallel to the sides 38 and which are spaced from these sides 38. The walls 46 and 48 define what may be referred to as the body (not numbered) of the holder 22. These side walls 48 extend rearwardly of the back 36 a comparatively short distance as indicated in FIG. 3 of the drawing. They are preferably are provided with elongated slots 50 serving as belt engagement means for the purpose of mounting the holder 22 on a belt 51 as shown in phantom in FIGS. 1, 2 and 3 of the drawings. When used with the holder 22 it extends through the slots 50 generally along the back 36 in such a manner as to bear lightly against the back 36 so as to serve to hold the container 20 generally within the holder 22 as shown.

The holding action securing the container 20 within the holder 22 is primarily derived from the use of two pawl like members 52, each of which is adapted to coact with one of the shoulders 44 as illustrated in FIG. 5. Because of their function as hereinafter described these members 52 serve as other coacting means. They serve to close off or block off an end (not numbered) of the holder 22. One of these pawl like members 52 is located directly upon the front wall 46 as illustrated in FIGS. 4, 5 and 6 of the drawings. The other of these pawl like members 52 is located upon a cross bar 54 which, as shown in FIGS. 4 and 6 of the drawings, extends directly between the side walls 48. This cross bar 54 is normally spaced from the container 20 as shown and is joined to the side wall 48 by small curved connectors 56.

Both the container 20 and the closure 30 are preferably formed by known conventional molding techniques of a waterproof, somewhat resilient thermoplastic material so as to be sufficiently thick so as to be substantially self supporting in character. The holder 22 is also preferably formed of such a composition. It will be recognized that quite a variety of different, commonly known polymeric materials possess the physical qualities or properties making them desirable in the manufacture of these parts. Among such materials are linear polyethylene, conventional grades of polypropylene and the like.

The operation of the container 20 is essentially quite simple. First a belt (not shown) will be secured in place in the obvious manner. Then the container 20 is normaly detached from the holder 22 by first pushing inwardly on the side walls 48 as indicated by the arrows in FIG. 6. This will tend to move the cross bar 54 from a position as shown by FIG. 4 to a position as shown by FIG. 6. As a consequence of this the members 52 will be moved apart a sufficient distance so that the shoulders 44 can be disengaged. This releases the ratchet member 40 so that the container 10 can be withdrawn.

At this point the closure 30 can be removed from the container 20 so that valuables such as currency, a drivers license, credit cards or the like, can be inserted within the body portion 26 of this container 20. If desired slots 57 can be provided in the walls 22 so that the closure 30 can be wedged in them so as to be held as the container 20 is filled. The closure 30 will then be replaced.

At this point the closed end 24 and a part of the body portion 26 can be moved within the holder 22 so that the front 34 is slid generally along the front wall 46. As there is movement in this manner the ratchet member 40 will be forced between the pawl like members 52 and the sloping surfaces 42 will tend to spring these pawl like members 52 away from one another until such time as the members 52 snap into place against the shoulders 44 as illustrated in FIG. 5. At this point the holder 22 will be securely held so that it is not apt to become accidentally dislodged until it is deliberately removed by its operation as indicated in the preceding.

Although the container 20 and the holder 22 can be used so that either the closed end 24 and the pawl like members 52 are at the top or at the bottom of the container 20 and the holder 22 as they are used in combination it is frequently preferred to utilize the container 20 and the holder 22 so that the closed end 24 and the pawl like members 52 are at the top of the combined structure consisting of the container 20 and the holder 22. This orientation is primarily important when the container 20 and the holder 22 are to be utilized in connection with water activities such as scuba diving and the like, but can also be important on occasion to hikers and others who are apt to wade streams or otherwise come in contact with water. This is because when the container 20 is oriented in this manner the air normally present within this container 20 will be trapped within it more or less as air is trapped within a diving bell. As a consequence of this anything within the container 20 will be reasonably secure against being damaged by water if there should be leakage between the closure 30 and the container 20.

Figure 8:
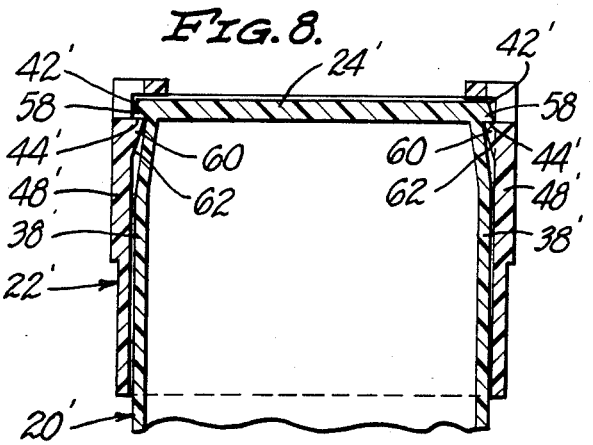
FIG. 8 is a cross-sectional view taken at line 8—8 of FIG. 7.
Figure 9:
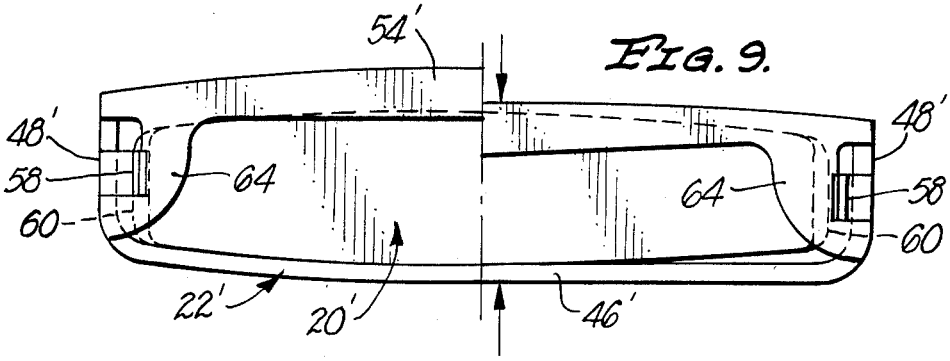
FIG. 9 is top end view of the container and holder combination shown in FIG. 7, the left hand portion of this figure showing the normal position of the holder and the right hand portion of this figure showing the position of the holder as the container is being attached to or detached from the holder.
Figure 10:
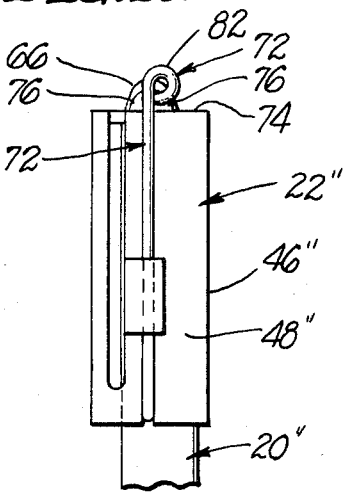
FIG. 10 is a side elevational view of a further modified container and holder of this invention used in combination with one another.
Figure 11:
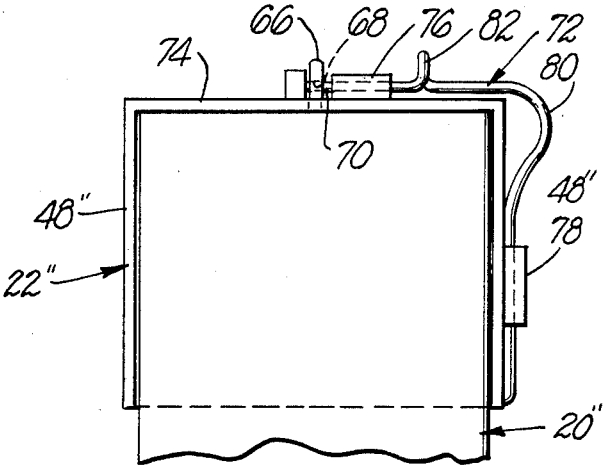
FIG. 11 is a rear elevational view thereof.
Figure 12:
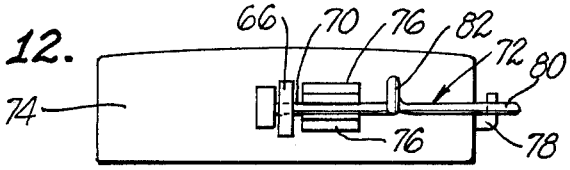
FIG. 12 is a top end view of the combination shown in FIGS. 10 and 11.

In FIGS. 7 through 9 of the drawings there are shown a modified container 20' and a modified holder 22' used in combination with one another and in FIGS. 10 to 12 there are shown a further modified container 20'' and holder 22'' used in combination. The containers 20' and 20'' and the holders 22' and 22'' are structurally very closely related to the container 20 and the holder 22 previously described. For this reason various parts of the containers 20' and 22'' and the holders 22' and 22'' which are the same or substantially the same as various parts of the container 20 and the holder 22 previously described are not separately described herein and are merely indicated in this discussion as necessary for explanatory purposes with the prime or the double of the numeral previously used to designate such part.

The container 20' differs from the container 20 by the omission of the ratchet member 40 and by the replacement of this ratchet member 40 with small ratchet tabs 58 serving as coacting means which appear as outwardly extending extensions of the closed end 24' located generally along the sides 38'. These tabs 58 have shoulders 44' which are adapted to coact with pawl like ends 60 on the side walls 48' of the holder 22' serving as other coacting means. These ends 60 also include sloping walls 62 which are adapted to facilitate the ends 60 sliding over the tabs 58 as the container 20' is being assembled along the holder 22'. Small sloping surfaces 42' are preferably still utilized for the purpose of facilitating assembly but are located on the tabs 58. In the holder 22' small stop wlls 64 extending between the cross bar 54' and the front wall 46' serve to partially close off the end (not separately numbered of the holder 22' corresponding to the end (not separately numbered) of the holder 22' closed off by the members 52. Thus these walls 64 in effect serve to limit the amount that the container 20' can be inserted into the holder 22'.

When the container 20' is secured as shown in FIGS. 7 and 8 in place it can easily be removed by pushing the cross bar 54' generally towards the front wall 46' or by pushing the front wall 46' generally towards the cross bar 54'. This will serve to deflect the side walls 48' generally outwardly away from the tabs 58 to a sufficient extent that the container 20' can be easily withdrawn. The container 20' can, of course, be reinserted into the holder 22' by merely being pressed into position to the degree necessary for the ends 60 to snap or pop over the shoulders 44'.

The modified container 20'' illustrated in FIGS. 10 through 12 of the drawings is quite similar to the container 20. It is the same except for the substitution of an ear 66 for the member 40. This ear 66 is provided with a small aperture 68 which is adapted to receive an end 70 of a small wire retainer 72. This ear 66 extends through an end wall 74 located so as to be supported by the front wall 46'' and the side walls 48'' of the holder 22''. This end wall 74 includes overhanging shoulder members 76 which are dimensioned so that the retainer 72 can be snapped between them in such a manner that these shoulder members 76 will serve as a form of a linear bearing. One of the side walls 48'' has a small tunnel like projection 78 through which the retainer 72 extends. As is shown, this retainer 72 preferably includes a bent or curved portion 80 serving more or less as a spring and a small bent loop or flange 82 serving more or less as a handle.

The retainer 72 employed with the container 20'' and the holder 22'' serves as a form of a coacting latch for engaging the coacting aperture 68 in the ear 66 so as to prevent movement of the container 20'' relative to the holder 22''. When it is desired to release the container 20'' the flange 82 may be manually engaged so as to temporarily deform the retainer 72 to the extent that the ear 66 is disengaged. This permits the container 20'' being withdrawn from the holder 22''. When the container 20'' is to be reassembled on the holder 22'' the flange 82 must again be engaged so as to temporarily deform the retainer 72 so as to permit the container 20'' to be inserted to such a point that when the flange 82 is released the retainer 72 will automatically engage the aperture 68.

It is believed that it will be apparent from the preceding that the various containers 20, 20' and 20'' and their corresponding holders 22, 22' and 22'' can be used together so as to provide an effective means of carrying various valuables on a person's body during such time that the person is dressed in such a manner that these valuables cannot be carried in a normal manner or is engaged in an activity such as swimming which could be detrimental to such valuables.

I claim:

1. In the combination of a container and a holder which is used to secure the container to a belt so that the container can be easily attached to or detached from the belt through the use of the holder the improvement which comprises:

said container having ends and a body portion extending between and separating said ends, said holder being shaped so as to include an open end, a closed end and a body portion extending between said ends and shaped so as to fit around at least a portion of said body portion of said container, said holder is formed of a material capable of being temporarily deformed, coacting means for removably securing one of said ends of said container to said closed end of said holder, one of said coacting means being located on said one of said ends of said container and the other of said coacting means being located on said closed end of said holder, said coacting means in said container comprises ratchet means, said coacting means on said holder comprises pawl means, said container is capable of being secured to said holder by moving said container through said open end of said holder so that said ratchet means engage said pawl means so as to be held thereby, said body portion of said holder is temporarily deformed when said pawl means contacts said ratchet means and reverts back to its initial position when said, ratchet means are engaged by said pawl means, said body portions of said holder are capable of being manipulated so as to be deformed to a sufficient extent to disengage said pawl means from said ratchet means, said holder also including belt engagement means for use in securing said holder to a belt.

2. The combination claimed in claim 1 wherein: said container is vertically oriented when attached to said holder, said coacting means are located at the upper most end of said container and at the upper most portion of said holder when said container is attached to said holder, the lower most end of said container is capable of being opened and is normally closed by a lid forming a fluid tight seal with the remainer of said container.

3. The combination claimed in claim 2 wherein:

said holder includes retaining means for holding said lid when said lid is removed from said container.

4. The combination claimed in claim 1 wherein:

said ratchet means includes two sloping surfaces leading to shoulders which are located generally parallel to and spaced from the closed end of said container, said body portion of said holder includes a front wall and side walls and a cross bar spaced from said front wall and extending between said side walls adjacent to said closed end of said holder, said pawl means comprise two pawl like member one of which is located on said front wall the other of which is located on said cross bar.

5. The combination as claimed in claim 1 wherein:

said container is vertically oriented when attached to said holder, said coacting means are located at the upper most end of said container and at the upper most portion of said holder when said container is attached to said holder, the lower most end of sid container is capable of being opened and is normally closed by a lid forming a fluid tight seal with the remainder of said container, said holder includes retaining means for holding said lid when said lid is removed from said container, said ratchet means includes two sloping surfaces leading to shoulders which are located generally parallel to and spaced from the closed end of said container, said body portion of said holder includes a front wall and side walls and a cross bar spaced from said front wall and extending between said side walls adjacent to said closed end of said holder, said pawl means comprise two pawl like members one of which is located on said front wall the other of which is located on said cross bar.

* * * * *

UNITED STATES PATENT AND TRADEMARK OFFICE

CERTIFICATE OF CORRECTION

PATENT NO. : 4,566,616

DATED : JANUARY 28, 1986

INVENTOR(S) : LEIF RISE

It is certified that error appears in the above-identified patent and that said Letters Patent is hereby corrected as shown below:

Column 1, line 47, delete the word "an".
Column 3, line 52, delete the word "are".
Column 4, line 34, "22" should be —48—.
Column 5, line 33, "wlls" should be —walls—.
Column 6, line 44, "in" should be —on—.
Column 6, line 54, delete the punctuation mark "," after the word "said".
Column 7, line 3, "remainer" should be —remainder—.
Column 7, line 17, "member" should be —members—.
Column 8, line 5, "sid" should be --said--.

Signed and Sealed this

*Twenty-seventh* Day of *May 1986*

[SEAL]

*Attest:*

DONALD J. QUIGG

*Attesting Officer*

*Commissioner of Patents and Trademarks*